US005538778A

United States Patent [19]

Hurwitz et al.

[11] Patent Number: 5,538,778

[45] Date of Patent: Jul. 23, 1996

[54] METHOD AND APPARATUS FOR PRODUCING INDIVIDUAL ROLLS OF PACKING MATERIAL

[75] Inventors: Michael C. Hurwitz, Wilton; David P. Goodrich; Roger E. Jester, both of Newtown; James P. Devine, Bethlehem, all of Conn.

[73] Assignee: Geopax Ltd, Sandy Hook, Conn.

[21] Appl. No.: 119,472

[22] Filed: Sep. 10, 1993

Related U.S. Application Data

[63] Continuation-in-part of Ser. No. 962,944, Oct. 19, 1992, abandoned, which is a continuation-in-part of Ser. No. 936,608, Aug. 27, 1992, abandoned, which is a continuation-in-part of Ser. No. 851,911, Mar. 16, 1992, abandoned.

[51] Int. Cl.[6] ..... B65D 85/30

[52] U.S. Cl. ..... 428/136; 428/906; 428/135; 428/137; 428/338; 428/220; 428/215; 428/212; 428/537.5; 428/903.3; 53/435; 53/450; 229/87.02; 206/814; 206/584; 206/585; 206/521; 29/6.1; 29/6.2

[58] Field of Search ..... 428/906, 135, 428/136, 137, 338, 220, 215, 212, 537.5, 903.6; 53/435, 450; 229/87.02; 206/814, 584, 585, 521; 29/6.1, 6.2

[56] References Cited

U.S. PATENT DOCUMENTS

| | | | |
|---|---|---|---|
| 2,656,291 | 10/1953 | Doll et al. | 428/135 |
| 4,856,655 | 8/1989 | Barsky | 206/524 |
| 4,949,528 | 8/1990 | Palik | 53/429 |
| 5,181,614 | 1/1993 | Watts | 206/584 |
| 5,203,761 | 4/1993 | Reichental et al. | 493/346 |
| 5,207,756 | 5/1993 | Alhamad et al. | 29/6.1 |

*Primary Examiner*—William P. Watkins, III
*Attorney, Agent, or Firm*—Sheldon H. Parker

[57] ABSTRACT

An expanded cushioning material for packing or packaging is in the form of a filled cylinder. The cylinder is formed from a spiral of an essentially flexible, extended sheet material. The flexible material, in its unexpanded form, has a plurality of spaced parallel rows of individual slits extending transversely from one end of the sheet material to the opposing end of the sheet material. Each of the rows have interval spaces between consecutive slits. The slits in each row are positioned adjacent the interval space between consecutive slits in the adjacent parallel row of slits. The sheet is expanded by extending the sheet in the direction normal to the parallel to the rows of slits to form an array of openings, generally similar in shape and size. The cells include inclined land areas and legs. The land areas of adjacent spiral layers are nested and interlocked and fill the interior of the cylinder. The sheet in substantially expanded form has a sufficient load bearing capacity and sufficient elastic potential energy to protect an article in transit against impact damage, by cushioning the article.

26 Claims, 5 Drawing Sheets

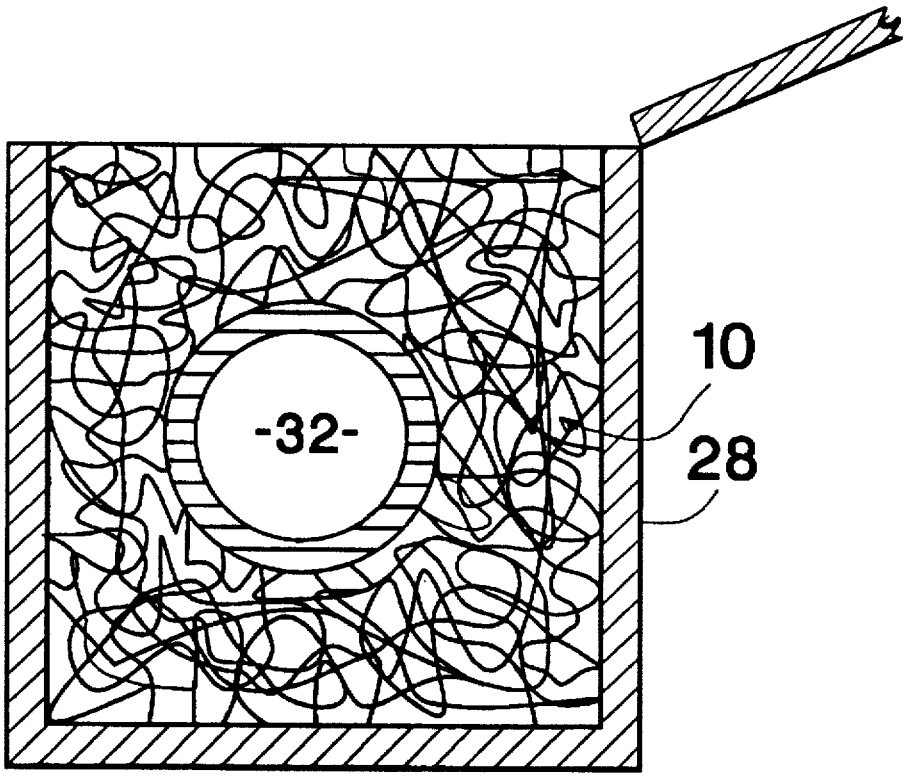
FIG. 4
FIG.3
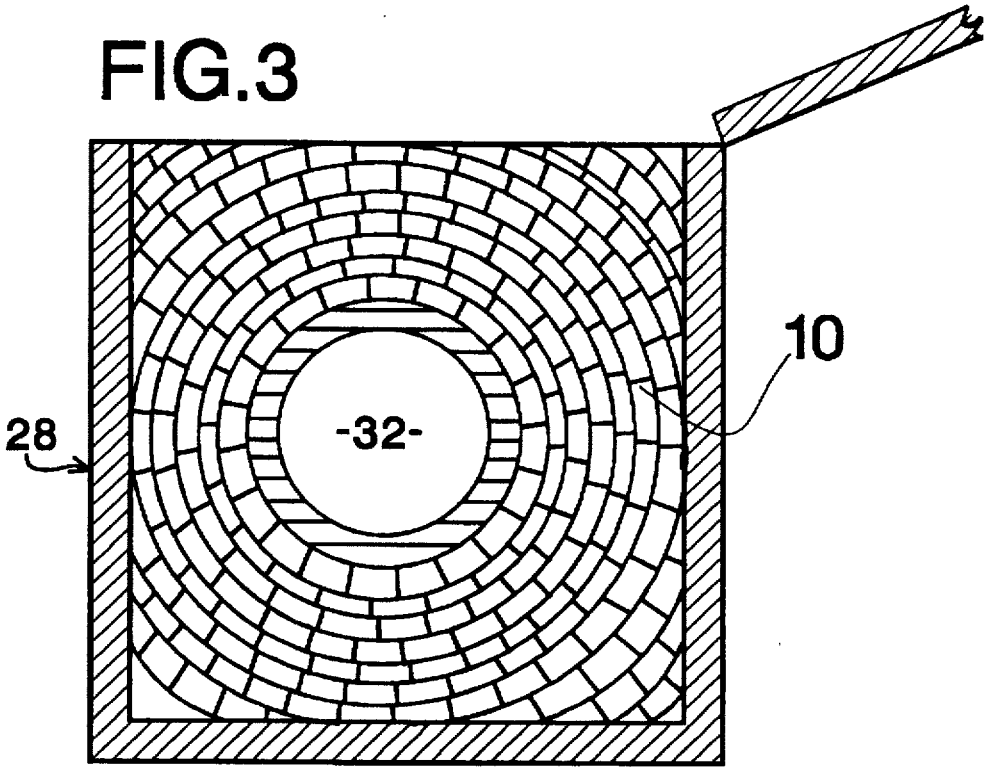

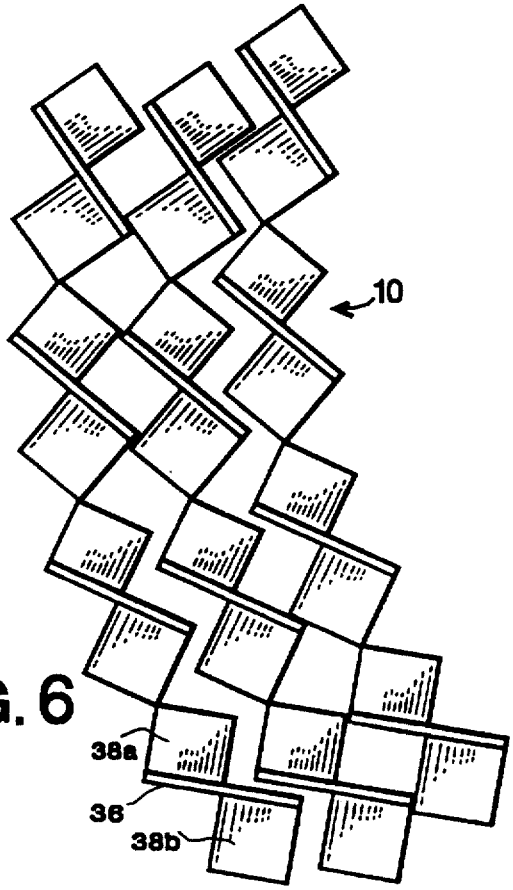
FIG. 6
FIG. 5
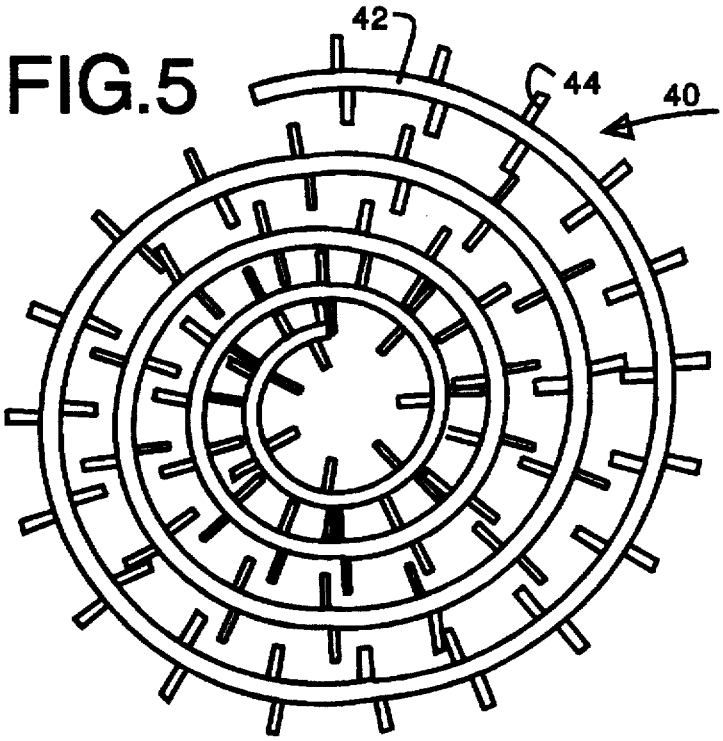

METHOD AND APPARATUS FOR PRODUCING INDIVIDUAL ROLLS OF PACKING MATERIAL

CROSS REFERENCE TO RELATED APPLICATION

This application is a continuation-in-part of application Ser. No. 07/962,944, filed Oct. 19, 1992 abandoned, which application is a continuation in part of Ser. No. 07/936,608, filed Aug. 27, 1992 abandoned, which application is a continuation in part of abandoned application Ser. No. 07/851,911, filed Mar. 16, 1992 abandoned, the disclosures of which are incorporated herein by reference, as though recited in full.

BACKGROUND OF THE INVENTION

1. Field of the Invention

The present invention relates in general to rolls of cushioning materials to be used in packaging, in conjunction with or independent of the packing material disclosed in U.S. Ser. No. 07,962,944, U.S. Ser. No. 07/936,608 and U.S. Ser. No. 07/851,911. The methods and apparatus to expand the packaging material and the methods of formation of the rolls are also disclosed.

2. Description of the Prior Art

Materials for use in filling hollow spaces in packaging or wrapping objects for protection in moving are well known in the prior art. However, to date, such materials have been either ineffective, such as newsprint, or ecologically unsound, such as styrofoam or plastic bubbles. Production of the styrofoam and plastic bubbles causes toxic waste as well as creating disposal problems. Although recycling of these products is possible, storage of the products for re-use is bulky and not generally feasible for home owners or some industries. Re-using bubble wrap material is not practical because of limited shelf life of the bubbles due to air loss. Another disadvantage of existing filling materials is they cannot be shipped in an unexpanded form, thereby creating shipping cost based on bulk.

U.S. Pat. No. 4,937,131 discloses a dunnage pad for use as cushioning. The sheet-like stock material is rolled inwardly to form a pair of pillow-like portions abutting one another. These portions are stitched, or otherwise fastened together. U.S. Pat. No. 3,799,039 discloses a mechanism which produces a dunnage-type product for use with packing, shipping, etc. The confirmation of the dunnage-type product does not allow the specific item to be wrapped, but rather cushions the item along the bottom and/or edges of a container.

While the prior art devices provide improvements in the areas intended, none of the prior art overcomes the problems associated with general shipping. None of the prior art patents disclose an environmentally safe, readily recyclable, and biodegradable material which can be wrapped around, and conform to, a delicate item.

The co-pending applications disclose an environmentally safe filling material preferably manufactured from recycled paper in various sizes to meet the user's needs. The cushioning effect of the filling paper is achieved through expansion at the time of use and therefore is shipped in an unexpanded form to provide an advantage for shipping and storage. In the instant invention the slit paper is rolled into rolls which are used to fill boxes, thereby cushioning the articles shipped. The instant invention also discloses the apparatus and method to make the rolls.

BRIEF DESCRIPTION OF THE DRAWINGS

The objects and advantages of the instant invention will be apparent when the specification is read in conjunction with the drawings, wherein:

FIG. 3 is a cutaway side view of an article wrapped with the expanded paper of FIG. 2;

FIG. 4 is a cutaway side view of an article packaged in the crumbled expanded paper of FIG. 2;

FIG. 5 is an end view of a representation of the spiral cylinder of the instant invention;

FIG. 6 is a partial end view of the expanded paper forming the spiral cylinder;

DETAILED DESCRIPTION OF THE INVENTION

Figure 1:
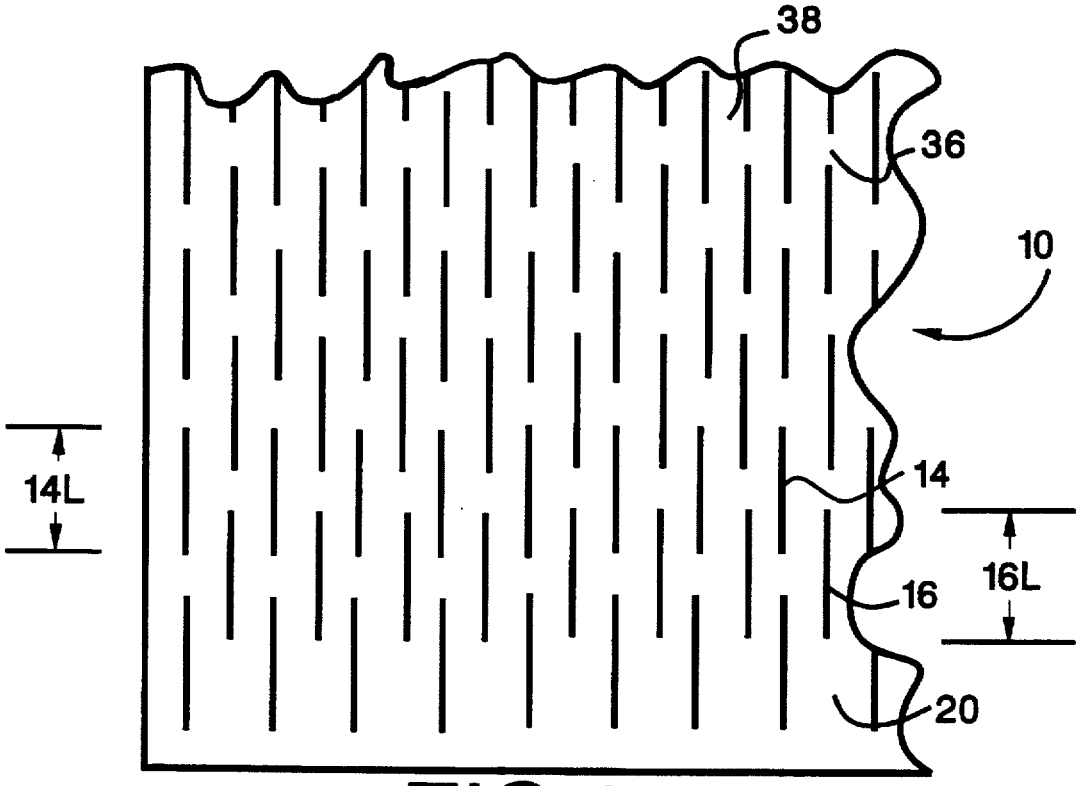
FIG. 1 is a top view of the slit, unexpanded paper used with the instant invention.

The instant disclosure relates to the method and equipment for the expansion of an expandable material, preferably slit, recycled paper as a packing material and to the use of the expanded material as a void fill in packaging. Optimum benefits are achieved when the expanded paper void fill is used in conjunction with the expanded material as a protective wrap for an article. The paper is slit as disclosed in the above noted co-pending application Ser. Nos. 07/926,944, 07/936,608, and 07/851,911.

In order to maintain clarity within the instant disclosure, the definitions of specific terms have been included herein. The definitions were obtained from *Elements of Physics,* G. Shortley and D. Williams, Second Edition, Prentice-Hall, Inc., Englewood Cliffs, N.J., 1955.

Stress is related to the force causing deformation. Strain is related to the amount of deformation.

Work is used in its technical definition. It is necessary for a force to act on a body and for the body to experience a displacement that has a component parallel to the direction in which the force is acting.

Energy is a measure of the capacity or ability of the body to perform work. It is a scalar quantity and is measured in the same units as work. The energy possessed by a body as a result of its motion is called kinetic energy. Energy possessed by a body as a result of its position or configuration is called potential energy. When referring to an elastic body, the energy is referred to as elastic potential energy. A cushioning material absorbs the energy of the article protected by the cushioning material. The elastic potential energy of the cushioning material is the amount of work the cushioning material can perform in absorbing the energy of the article.

Hookes Law—the deformation of an elastic body is directly proportional to the magnitude of the applied force, provided the elastic limit is not exceeded. The expanded material of the instant invention does not exhibit a straight line relationship between the deformation and the magnitude of the applied force. The relationship more nearly follows the curve which is characteristic of rubber, as shown on page 182 of Elements of Physics.

Elastic body is one that experiences a change in volume or shape when the deforming forces act upon it but resumes its original size or shape when the deforming forces cease to act.

Elastic force is the force exerted by the body by virtue of its deformation.

Yield point, the point beyond stress when a large increase in strain occurs with almost no increase in stress.

The paper, once expanded creates semi-rigid peaks or lands. These peaks are similar to a spring in that once force is applied and removed, they will return to their original positioning, providing their elastic limit is not exceeded. The elastic force created by the resistance of the paper fibers slows the acceleration of the force. The work performed by movement of the semi-rigid peaks as a force is applied by an article, is the elastic potential energy of the expanded material.

The use of expanded paper in widths ½ inch increments from ½ inch to 6 inches and lengths varying from 3 to 24 inches was tested as a void fill. The material was found to retract to some degree if not bound at the ends or wrapped around an article. Thus, optimum expansion of the paper was difficult to achieve. Furthermore, the ratio of square feet of material required to produce the desired cubic inches of void fill, was not optimally cost effective. By winding the paper in the form of a cylinder, the tension on the expanded paper could be maintained without the use of adhesives or the like, since it is characteristic of the expanded slit paper material's cells to "interlock," thus preventing unwinding of the completed cylinders. Expanded paper cylinders were attached to hand-made cardboard cores and wound around the cores. Cylinders ranging in size from about 1×1 inch to 6×6 inches were tested. All sizes worked, with the 2×2 size being most effective. The solid core presented a rigid surface and lacked cushioning for side impact. It should be remembered that the sheet material decreases in width during the expansion step and the dimensions of the cylinder are in terms of final dimension of the finished cylinder. Cylinders less than 1 inch in length have a tendency to unravel, due to insufficient interlocking of cells, with the problem increasing with decreasing length. Additionally, cylinders under 1 inch in diameter offer insufficient cushioning effect for general applications. In terms of the correlation between unexpanded flat sheet material and finished cylinders, one square foot of sheet material will produce about two and three quarter finished cylinders. One 2×2 cylinder equals 0.376 square feet of sheet material. Obviously, the tighter the cylinder is wound, the greater the amount of sheet material is required to form a cylinder. Thus, the aforenoted correlation between sheet material square feet and cylinder diameter and length, is a measure of how tightly the cylinder is wound. The tighter the cylinder is wound, the firmer the cushion effect which is achieved. However, winding the cylinder too tightly will have the effect of removing air from the cylinders and lessening the cushioning qualities of the cylinders. Hence, winding forces on the slit paper material and the quantity of slit paper material used to produce a cylinder are critical. Thus, the cylinders can be customized to meet specific system requirements.

Coreless cylinders were formed using hand powered winders. The coreless cylinders were better at absorbing impact at the sides and edges of the cylinders, than was experienced with the rigid core centered cylinders. However, the number of square feet of sheet material required to produce a cubic foot of coreless cylinders was higher than optimally desired, from a cost standpoint. On the other hand, the coreless cylinders provided highly effective cushioning characteristics.

Using a small hand winder, cylinders were produced with a hollow core and characterized by a 40 square feet (unexpanded sheet material) to 1 cubic foot of cylinder. The hollow core cylinders provided excellent impact and vibration protection. The hollow center spiral wound expanded paper provided a greater degree of soft cushioning than was provided by the tightly wound coreless cylinders of expanded paper. The cylinder of expanded paper with a hollow core center provided an excellent compromise between excessive use of raw material in the tightly wound cores and lack of side impact protection and added expense associated with the production of expanded paper cylinders with a rigid core.

In order to more easily describe the instant application, the FIGS. 1–4 herein are being incorporated from co-pending application Ser. No. 07/936,608 and the descriptions briefly repeated in order to allow the instant disclosure to read more smoothly.

FIG. 1 illustrates a portion of the cut, unopened sheet 10, showing the unopened slits 14 and 16 and the proportions between the slits 14 and 16 and the land 20. It can be seen from this drawing that the slit length 14L and 16L are uniform throughout the sheet 10, as well as the area between the row spacing 38 and the slit spacing 36.

Figure 2:
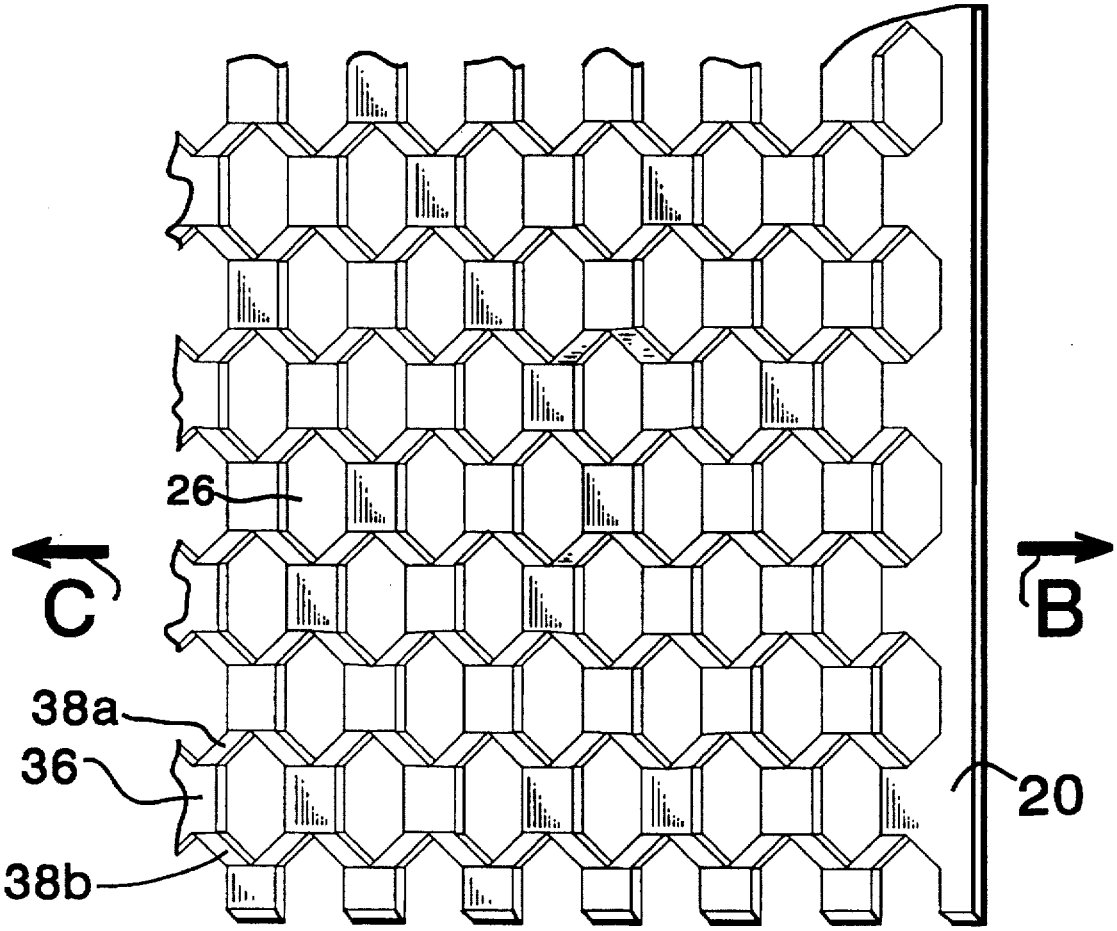
FIG. 2 is a top view of the expanded paper used with the instant invention.

In FIG. 2 the sheet 10 has been pulled in the direction of arrows B and C and opened to its optimum separation. The slits 14 and 16 have formed hexagonal cells 26, the slit spacing 36 has been angled, and the row spacing 38*a* and 38*b* has been warped to slightly less than a 90° angle. Row spacing 38*a* and 38*b* are basic mirror images of one another and connect the slit spacing 36 forming the hexagons. A more detailed description regarding the expansion process is disclosed in the above-identified co-pending applications.

FIGS. 3 and 4 illustrate two methods, as disclosed in the co-pending applications, for packaging items. In FIG. 3, the article 32 is rolled with a sufficient quantity of the expanded sheet 10 to fill the shipping box 28. In FIG. 4, the expanded sheet 10 is crumbled within the shipping box 28 to approximately the ¼ point. The article 32 is then placed in the shipping box 28 and the remaining space filled with the crumbled expanded sheet 10.

The cylinder of the instant disclosure is a combination of the foregoing methods, combining the concepts of the two. The slit paper is expanded and rolled into a cylindrical spiral, having a predetermined diameter and altitude based on end use. As disclosed, as the paper is expanded, it forms raised cells. When the paper is rolled, these cells interlock with the adjacent layers as the paper spirals outward. The interlocking of the cells eliminates the need to secure the cylinders, thereby making them immediately ready for use. The spiral cylinder 40 of FIG. 5 is a conceptual illustration of an end view. The spiral cylinder 40 in FIG. 5 shows the concept of the interlocking cells 26 raised from the land 20 (FIG. 2), however for clarity, rectangles are used to depict the cells formed by the row spacing 44 (38*a* and 38*b* of FIG. 2) and the slit spacing 42 (36 of FIG. 2).

In FIG. 6, a portion of the spiral cylinder 12 is illustrated which more accurately depicts the formation of the cells 26. The actual cells 26 cannot be seen in the side view of FIG. 6, however the material forming the cells is depicted. The row spacing 38*a* and 38*b* and the slit spacing 36 are warped, thereby forming the peaks and valleys which interlock with one another.

The self-locked cylinder provides maximum protection of article by absorbing the energy created by the impact. The absorbency is achieved by placing the layers in a position to force interaction between the cells. The positioning of the paper in a spiral prevents the paper from turning back on itself or twisting and thereby lessening the effect from the cell interaction. The spiral configuration is not only the most economical and easy to produce, it is structurally the most effective. The force applied to the cylindrical elastic body compresses in toward the center, with each interior layer creating an elastic force to return to its original position. The interaction of the cells additionally distributes the impact force through the entire cylinder, thereby providing increased protection of edge or corners of the object being shipped. This is unlike the commonly used styrofoam peanuts which act independently. With the styrofoam peanuts, if the corner of an item receives the main force of impact, the peanuts separate, thereby allowing the item to slide within the box. The interlocking of the cells of the cylinders not only interlocks each individual cylinder but locks the cylinders to one another, preventing slippage of the item within the box.

The spiral cylinder 10 can be varied in size dependent upon the intended use. The preferable size is approximately 2 inches in length and 1½–2 inches in diameter. The hollow core cylinders provides good packaging protection from all angles of impact and utilized the square footage within the core most efficiently. Desired results are obtained with paper weight of 70 pound of recycled Kraft, 100% post consumer recylced paper. Paper size of 3.2 inches by 16 inches (52 square inches of unexpanded slit paper) produces one hollow core cylinder. One hundred twenty cylinders, representing 40 square feet of unexpanded paper, fill one cubic foot volume as opposed to 210 tightly wound coreless cylinders being required to fill the same volume. Cylinders with a rigid cardboard core required 110 cylinders to fill one cubic foot. One cubic foot of unexpanded 70 lb. slit paper produces 37.2 cubic feet for void filling purposes when utilizing the hollow core method.

Figure 7:
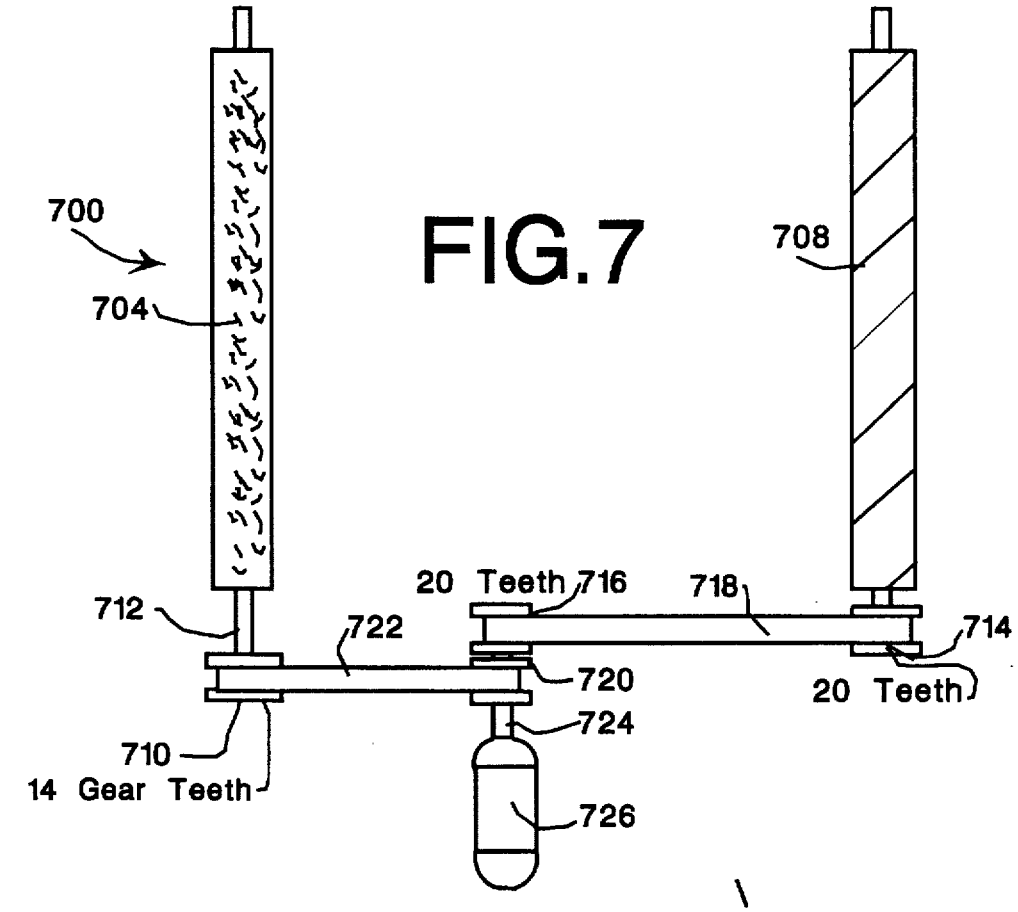
FIG. 7 is a top view to the expansion machine of the instant invention.
Figure 8:
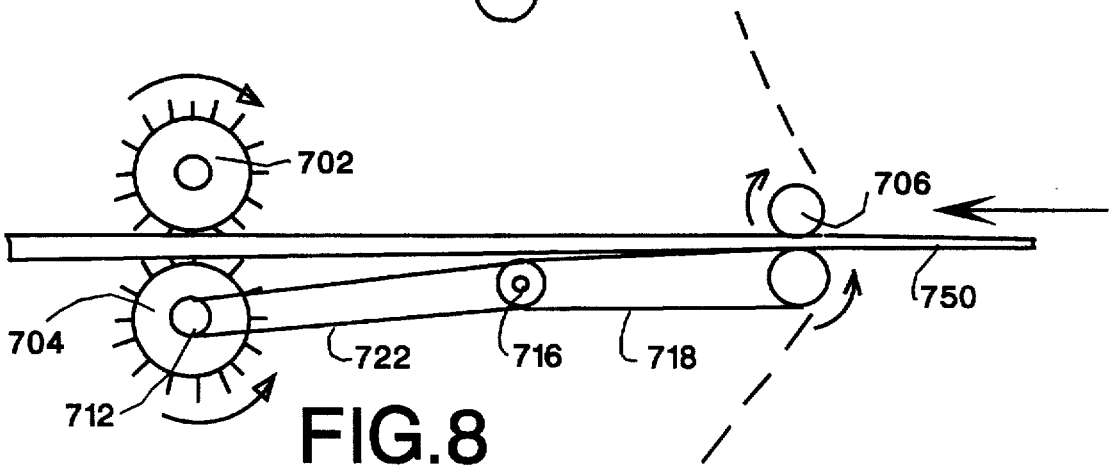
FIG. 8 is a side view of the expansion machine of FIG. 7.

FIGS. 7 and 8 illustrate the expansion machine 700 which rapidly produces optimum expansion of the slit paper 750. The paper is fed from a storage roll, not shown, to the upper and lower drive rollers 706 and 708, where it is placed between the rollers 706 and 708. The paper storage roll can be placed at any point along a 100° arch from the drive rollers 706 and 708, using the point directly perpendicular from the drive rollers 706 and 708 as the 0° point. Both the upper drive roller 706 and the lower drive roller 708 are covered with a friction material, such as shrink tubular material made of a heat shrinkable polymer, as for example polyvinyl chloride. Alternatively, a rubber spray or painted coating can be used. Additionally vinyl tape covered rollers and rubber rollers can be used. Abrasive coatings tended to produce some scratching of the paper and formation of dust due to the action of the abrasive material on the paper.

There is no theoretical upper limit to the amount of friction caused by the roller fiction covering, except that damage to the paper must be avoided. Therefore, the use of a coarse material is to be avoided.

The tension between the drive rollers and the expansion rollers must be sufficient to open, or expand the slit paper, but not sufficient to tear the paper. Typically, with a 30 pound paper, 2.5 oz. of force per linear inch, can be applied and with 70 pound paper, 5 oz. of force can be applied. The expansion should be sufficient to not only expand the paper, but also to crack some of the fibers, thereby decreasing the tendency of the paper to return to its unexpanded form.

With a 70 pound paper, it required a 0.011 hp motor to deliver paper at a rate of 300 inches per minute, expanded one linear inch.

Utilizing a 20 by 36 inch sheet of unexpanded 70 pound, 100% post consumer recycled Kraft paper, with one end secured in a rigid fixture across it entire width, the paper was suspended vertically and a force was applied to the paper to expand the paper. It was found that a force of about 50 ounces, that is, 2.5 oz. per inch, initiated the expansion of the paper; 3 oz. per linear inch opened all of the paper cells; 5 oz. per linear inch opened all cells fully and yielded cell wall fiber tearing which aids cell walls to remain open after the expanded paper is released in the open position; 7.5 oz. expanded the paper and tore it after 10 seconds of continued stress; 10 oz. per linear inch opened the cells and immediately tore the paper. The use of about 5 oz. was thus shown to provide the optimum results.

The lower drive roller 708 is driven by the motor 726 through the rotation of the motor gear 716 and drive gear 714. The rotation created by the motor 726 is transmitted along motor shaft 724 to the motor gear 716 where it drives the drive belt 718, which in turn rotates the drive gear 714. The motor gear 720, also connected to the motor shaft 724, drives the expansion belt 722, which in turn rotates the expansion gear 710. Due to the spacing of the motor gear 716 and the motor gear 720 along the motor shaft 724, an expansion shaft 712 is generally provided between the expansion gear 710 and the upper expansion roller 702 and lower expansion roller 704. The drive gear 714 is provided with 20 teeth as compared to the expansion gear 710 which has 14 teeth. The difference in the number of teeth changes the rotation speed of the upper expansion roller 702 and lower expansion roller 704 as compared to the upper drive roller 706 and lower drive roller 708. This allows the motor shaft 724 to rotate at a single speed. The differential can be obtained by a number of methods known in the prior art and the foregoing is not intended to limit the scope of the invention. The speed differential between the upper and lower expansion rollers 702 and 704 and the upper and lower drive rollers 706 and 708 is critical as it provides the expansion of the slit paper 750. The slit paper 750 is being removed from the expansion machine 700 faster than it is entering, thereby forcing the slit paper 750 to expand. The speed differential between the expansion rollers 702 and 704 and the drive rollers 706 and 708 must be calculated to provide the required amount of expansion based on the weight of paper and end use. In the gear assembly as illustrated in FIGS. 7 and 8, the expansion gear 710 and drive gear 714 can be changed to provide a increase or decrease in the speed differential. Other methods of changing the speed differential can be obtained and are known in the prior art.

The spacing of the expansion rollers a distance of about 6 inches from the drive rollers produced some binding in the middle of the paper, apparently due to the contraction of the paper which coincides with the expansion of the paper in thickness and length. A space between the expansion and drive rollers of about 11.25 inches worked well for 19.5 inch rolled paper and with 3 inch wide paper, a minimum of 4 inches of separation between the roller sets. The distance between the drive rollers and the expansion rollers varies proportionally with the width of the unexpanded paper.

It should be understood that the expansion device can be used to produce expanded product for use directly as a wrapping material. The automated roll dispenser provides for immediate use of the expanded paper minimizing space requirements while yielding maximum packaging usage by allowing the user to pull tightly during the wrapping process by stopping or braking when needed. At the end of wrapping, prior to tearing, the foot pedal is released and the automated expander brakes for final pulling and tearing. This leaves the process of maximum stretch intact for greatest packaging protection. An electronic unit can be employed to deliver measured quantities of expanded paper. Breaking at the end of the delivery provides for the user to tear the desired length of paper from the roll of paper. Alternatively, a cutting blade can be used to sever the delivered quantity of paper from the remainder of the roll.

The upper expansion roller 702 and the lower expansion roller 704 are covered with a material which provides the affect of fingers. The covering must grip the unopened slit paper, without ripping the paper, and pull it open through use of the differential speed between the expansion rollers 702 and 704 and the driver rollers 706 and 708. The use of soft rubber covered rollers works to produce even expansion over the width of the paper. However, deformation of the paper can be experienced, in the form of crushed cells. That is, at the point of contact with the pair of expansion rollers, the expanded cells can be crushed by the rollers. The use of open cell and light foam can work to provide the required expansion. However, low density, open cell foam have a life span which is shorter than optimally desired. When soft bristled brushes of the type employed in photocopy machine, were used, some difficulty was experienced in starting the expansion process. With the use of harder bristled brushes, a tendency to have some trouble in releasing the paper was experienced. Optimum results were obtained with medium stiff bristles cut to approximately ⅛ inch in length.

The preferred material is a nylon hook fiber of the type found in hook and loop fasteners of the type sold under the trademark VELCRO. The use of a set of rollers faced with hook ended fibers provided the required expansion without distortion of the expanded paper or deterioration of the rollers. Unlike, relatively firm foam covered rollers, the hook fibers did not crush the expanded cells as they passed between the expansion rollers. It should be understood that the role of the expansion rollers is critical in that they must be able to grip and pull the paper so as to impart a speed of travel to the paper which is greater than the speed of the paper when it passes through the drive rollers. This requirement is in conflict with the need to permit the expanded paper to pass between the rollers without the expanded cells being crushed.

Bristles can be made of metal wire, such as carbon steel, stainless steel, brass, bronze.

Commercially available bristles dimensions are as follows, for the above specified metals:

| Diameter | Length | Number per square inch |
|---|---|---|
| .013 | .125 | 175 |
| .021 | " | 165 |
| .035 | " | 150 |
| .065 | " | 125 |
| .013 | .250 | 175 |
| .021 | " | 165 |
| .035 | " | 150 |
| .065 | " | 125 |
| .013 | .50 | 175 |
| .021 | " | 165 |
| .035 | " | 150 |
| .021 | .750 | 165 |
| .035 | " | 150 |
| .065 | " | 125 |

Brass and Bronze wire bristles are commercially available in the following dimensions:

| Diameter | Length | Number per square inch |
|---|---|---|
| .029 | .750 | 165 |
| .046 | " | 165 |
| .021 | 1.0 | 165 |
| .029 | " | 165 |
| 0.46 | " | 165 |

Natural hog and horse hair bristles are available commercially, in the following dimensions:

| Diameter | Length | Number per square inch |
|---|---|---|
| .010 | .5 | 150 |
| " | " | " |
| " | " | " |

Synthetic polymeric materials, such as vinyl polymers, polyethylene, polypropylene, polystyrene, and vinylidiene chloride are commercially available in the following sizes:

| Diameter | Length | Number per square inch |
|---|---|---|
| .008 | .125 | 230 |
| .010 | " | 210 |
| .019 | " | 190 |
| .025 | " | 185 |
| .035 | " | 175 |
| .008 | .25 | 230 |
| .010 | " | 210 |
| .019 | " | 190 |
| .025 | " | 185 |
| .035 | " | 175 |
| .010 | .50 | 210 |
| .019 | " | 190 |
| .025 | " | 185 |
| .035 | " | 175 |

The 0.010/0.125/190 vinyl polymer bristles produced desired results, but other sizes and materials can be used.

What is claimed is:

1. A void fill material for use in packing or packaging comprising:

a filled cylinder formed from a spiral of an essentially flexible, extended sheet material;

said flexible material, in its unexpanded form, having a plurality of spaced parallel rows of individual slits extending transversely from one end of the sheet material to the opposing end of said sheet material, each of said rows having interval spaces between consecutive slits;

said slits in each row being positioned adjacent the interval space between consecutive slits in the adjacent parallel row of slits;

said sheet being expanded by extending the sheet in the direction normal to the parallel to the rows of slits whereby the slits form an array of openings, each opening being generally similar in shape and size, and being formed by inclined land areas and legs, wherein said land areas of adjacent spiral layers are nested and interlocked and fill the interior of said cylinder, said sheet in substantially expanded form having a sufficient load bearing capacity and sufficient elastic potential energy to protect an article in transit against impact damage, by cushioning said article.

2. The expanded cushioning material of claim 1, wherein said load bearing capacity of a single layer of said sheet material is in the range from about 250 lb. per square foot to about 2000 lb. per square foot of expanded material.

3. The expanded cushioning material of claim 1, wherein said load bearing capacity of a single layer of said sheet material is at least about 400 lb. per square foot of expanded material.

4. The expanded cushioning material according to claim 1, wherein said sheet material has an expanded thickness on the order of at least about ten times the unexpanded thickness of said sheet.

5. The expanded cushioning material according to claim 1, wherein said cylinder has a diameter in the range from about one half inch to about two inches.

6. The expanded cushioning material according to claim 1, wherein said cylinder has a longitudinal dimension in the range from about one inch to about six inches.

7. The expanded cushioning material according to claim 1, wherein said expanded sheet material is formed of cellulosic fibers.

8. The expanded cushioning material according to claim 1, wherein each layer of said sheet material has an unexpanded thickness on the order of less than about 0.03 inches and an expanded thickness on the order of at least about ten times said unexpanded thickness.

9. The expanded cushioning material according to claim 1, wherein said expanded sheet material prior to being wound in a spiral lies essentially in a primary plane, said expanded sheet being formed of openings and land areas, at least a majority of said land areas lying in a plurality of parallel secondary planes, said plurality of parallel secondary planes forming an angle of at least about 45 degrees with said primary plane, and wherein said land areas of adjacent layers are nested and interlocked.

10. The expanded cushioning material according to claim 1, wherein a single layer of said expanded cushioning material has a deformation capacity of at least about a twentieth of an inch per layer, under a load of about 500 pounds per square foot of expanded material.

11. The expanded cushioning material according to claim 10 wherein the load bearing capacity is up to about 2000 lb. per square foot of expanded material.

12. The expanded cushioning material according to claim 10, wherein said expanded cushioning material has a total deformation capacity of at least about 25%.

13. A method of protecting an object for shipping, comprising the steps of:

placing said object in a container, filling the void space in said container with a plurality of cylinders of extended material, said extended material being formed of at least one spirally wound sheet of flexible, non-woven fibrous material;

said at least one sheet having a plurality of spaced parallel rows of individual slits extending transversely from one end of the material to the opposing end of said at least one sheet, each of said rows having interval spaces between consecutive slits;

said slits in each row being positioned adjacent the interval space between consecutive slits in the adjacent parallel row of slits;

said material being expanded in length and thickness by extending the opposing ends of each sheet which are parallel to the rows of slits whereby the slits form an array of openings, each opening being generally similar in shape and size, thereby forming a substantially expanded sheet having a sufficient load bearing capacity and sufficient elastic potential energy to protect an article in transit against impact damage, by cushioning the article;

said extended material being formed into a cylindrical configuration by forming a spiral of said extended material, thereby forming a cylinder of spirally expanded material.

14. The method according to claim 13, wherein said material is paper and said paper has a thickness on the order of less than about 0.03 inches and said material is expanded to a thickness on the order of at least about ten times the unexpanded thickness of said paper prior to wrapping said object with said paper.

15. The method according to claim 13, comprising the step of forming said extended material into cylinders having a longitudinal dimension in the range from about 1 inch to about 6 inches and having a diameter in the range from about one half inch to about two inches.

16. The method according to claim 14, wherein said material is formed of cellulosic fibers.

17. The method according to claim 13, wherein said load bearing capacity of a single layer of said sheet material is in the range from about 250 lb. per square foot to about 2000 lb. per square foot of expanded material.

18. The method according to claim 13, wherein said load bearing capacity of a single layer of said sheet material is at least about 400 lb. per square foot of expanded material.

19. The expanded cushioning material according to claim 13, wherein said sheet material has an expanded thickness on the order of at least about ten times the unexpanded thickness of said sheet.

20. The method according to claim 13, wherein said sheet material is recycled paper.

21. The method according to claim 13, wherein said expanded sheet material prior to being wound in a spiral lies essentially in a primary plane, said expanded sheet being formed of openings and land areas, at least a majority of said land areas lying in a plurality of parallel secondary planes, said plurality of parallel secondary planes forming an angle of at least about 45 degrees with said primary plane but less than 90 degrees, thereby filling the interior of said cylinder with sheet material which extends at an angle from said expanded sheet material.

22. The method according to claim 21, wherein each layer of said sheet material has an unexpanded thickness on the order of less than about 0.03 inches and an expanded thickness on the order of at least about ten times said unexpanded thickness.

23. The method according to claim 13, wherein a single layer of said method has a deformation capacity of at least about a twentieth of an inch, under a load of about 500 pounds per square foot of expanded material.

24. The method according to claim 23, wherein said single layer of expanded material has a total deformation capacity of at least about 25%.

25. The method according to claim 13, comprising the step of forming said extended material into cylinders having a longitudinal dimension in the range from about 1 inch to about 6 inches and having a diameter in the range from about one half inch to about two inches and wherein said load bearing capacity of a single layer of said sheet material is in the range from about 400 lb. per square foot to about 2000 lb. per square foot of expanded material, each layer of said sheet material has an unexpanded thickness on the order of less than about 0.03 inches and an expanded thickness on the order of at least about ten times said unexpanded thickness, said expanded sheet material prior to being wound in a spiral lies essentially in a primary plane, said expanded sheet being formed of openings and land areas, at least a majority of said land areas lying in a plurality of parallel secondary planes, said plurality of parallel secondary planes forming an angle of at least about 45 degrees with said primary plane, whereby said land areas of adjacent layers are nested and interlocked, wherein a single layer of said extended material has a deformation capacity of at least about a twentieth of an inch per layer, under a load of about 500 pounds per square foot of expanded material and a total deformation capacity of at least about 25%.

26. The expanded cushioning material according to claim 1, further comprising;

said cylinders having a longitudinal dimension in the range from about 1 inch to about 6 inches and having a diameter in the range from about one half inch to about two inches, said load bearing capacity of a single layer of said sheet material is in the range from about 400 lb. per square foot to about 2000 lb. per square foot of expanded material, said cylinder has a diameter in the range from about one half inch to about two inches, said cylinder has a axial dimension in the range from about one inch to about six inches, said spiral wound expanded material having open cells surrounded by land areas and wherein said land areas of adjacent layers are nested and interlocked, each layer of said sheet material has an unexpanded thickness on the order of less than about 0.03 inches and an expanded thickness on the order of at least about ten times said unexpanded thickness, said expanded sheet material prior to being wound in a spiral lies essentially in a primary plane, said expanded sheet being formed of openings and land areas, at least a majority of said land areas lying in a plurality of parallel secondary planes, said plurality of parallel secondary planes forming an angle of at least about 45 degrees with said primary plane, whereby said land areas of adjacent layers are nested and interlocked, wherein a single layer of said extended material has a deformation capacity of at least about a twentieth of an inch per layer, under a load of about 500 pounds per square foot of expanded material and a total deformation capacity of at least about 25%.

* * * * *